US007692521B1

(12) United States Patent
Cohn

(10) Patent No.: US 7,692,521 B1
(45) Date of Patent: Apr. 6, 2010

(54) HIGH FORCE MEMS DEVICE

(75) Inventor: Michael B. Cohn, Berkeley, CA (US)

(73) Assignee: Microassembly Technologies, Inc., Richmond, CA (US)

( * ) Notice: Subject to any disclaimer, the term of this patent is extended or adjusted under 35 U.S.C. 154(b) by 443 days.

(21) Appl. No.: 11/433,044

(22) Filed: May 12, 2006

Related U.S. Application Data

(60) Provisional application No. 60/679,817, filed on May 12, 2005.

(51) Int. Cl.
*H01H 51/22* (2006.01)

(52) U.S. Cl. ..... 335/78; 200/181; 303/101

(58) Field of Classification Search ..... 335/78, 335/75; 200/181; 333/101
See application file for complete search history.

(56) References Cited

U.S. PATENT DOCUMENTS

| | | | | |
|---|---|---|---|---|
| 4,893,172 | A | 1/1990 | Matsumoto et al. | |
| 5,258,591 | A | 11/1993 | Buck | |
| 5,367,136 | A | 11/1994 | Buck | |
| 5,430,421 | A | 7/1995 | Bornand et al. | |
| 5,472,539 | A | 12/1995 | Saia et al. | |
| 5,476,211 | A | 12/1995 | Khandros | |
| 5,578,869 | A | 11/1996 | Hoffman et al. | |
| 5,578,976 | A | 11/1996 | Yao | |
| 5,600,071 | A | 2/1997 | Sooriakumar et al. | |
| 5,629,918 | A | 5/1997 | Ho et al. | |
| 5,659,195 | A | 8/1997 | Kaiser et al. | |
| 5,731,636 | A | 3/1998 | Chun | |
| 5,744,752 | A | 4/1998 | McHerron et al. | |
| 5,778,513 | A | 7/1998 | Miu et al. | |
| 5,821,161 | A | 10/1998 | Covell, II et al. | |
| 5,832,601 | A | 11/1998 | Eldridge et al. | |
| 5,874,675 | A | 2/1999 | Edmans et al. | |
| 5,917,707 | A | 6/1999 | Khandros et al. | |
| 5,938,956 | A | 8/1999 | Hembree et al. | |
| 5,949,655 | A | 9/1999 | Glenn | |
| 5,955,932 | A * | 9/1999 | Nguyen et al. | 333/186 |
| 5,995,688 | A | 11/1999 | Aksyuk et al. | |
| 6,000,280 | A | 12/1999 | Miller et al. | |
| 6,025,767 | A | 2/2000 | Kellam et al. | |

(Continued)

FOREIGN PATENT DOCUMENTS

| | | |
|---|---|---|
| EP | 0183910 | 1/1989 |

(Continued)

OTHER PUBLICATIONS

Cohn, M.B. et al., "Microassembly Technologies for MEMS," Proc. SPIE, 1998, 15 pages, vol. 3514, No. 2.

(Continued)

*Primary Examiner*—Anh T Mai
*Assistant Examiner*—Bernard Rojas
(74) *Attorney, Agent, or Firm*—Fenwick & West LLP

(57) ABSTRACT

Problems with the short lifetime of MEMS devices, low actuation forces, contaminant build-up on contacts, etc. are minimized by a MEMS device with an improved cantilever design that enables high force while maintaining large gaps. The improved cantilever design both allows for high force and fast switching while minimizing damage to contacts. The improved design can be fabricated on one or two substrates, which are bonded together with a seal ring to provide a packaged MEMS device.

76 Claims, 5 Drawing Sheets

U.S. PATENT DOCUMENTS

| | | | | |
|---|---|---|---|---|
| 6,049,976 | A | 4/2000 | Khandros | |
| 6,066,515 | A | 5/2000 | Schoenfeld | |
| 6,117,694 | A | 9/2000 | Smith et al. | |
| 6,124,650 | A * | 9/2000 | Bishop et al. | 310/40 MM |
| 6,137,184 | A | 10/2000 | Ikegami | |
| 6,142,358 | A | 11/2000 | Cohn et al. | |
| 6,158,283 | A | 12/2000 | Shinogi et al. | |
| 6,177,730 | B1 | 1/2001 | Kira et al. | |
| 6,184,053 | B1 | 2/2001 | Eldridge et al. | |
| 6,265,246 | B1 | 7/2001 | Ruby et al. | |
| 6,287,894 | B1 | 9/2001 | Sawin | |
| 6,297,072 | B1 | 10/2001 | Tilmans et al. | |
| 6,303,992 | B1 | 10/2001 | Van Pham et al. | |
| 6,346,742 | B1 | 2/2002 | Bryzek et al. | |
| 6,384,353 | B1 * | 5/2002 | Huang et al. | 200/181 |
| 6,426,484 | B1 | 7/2002 | Hembree et al. | |
| 6,429,511 | B2 | 8/2002 | Ruby et al. | |
| 6,469,602 | B2 | 10/2002 | Ruan et al. | |
| 6,566,745 | B1 | 5/2003 | Beyne et al. | |
| 6,596,117 | B2 | 7/2003 | Hays et al. | |
| 6,614,110 | B1 | 9/2003 | Pace | |
| 6,621,616 | B1 | 9/2003 | Bauer et al. | |
| 6,624,003 | B1 | 9/2003 | Rice | |
| 6,633,212 | B1 * | 10/2003 | Ruan et al. | 335/78 |
| 6,794,964 | B2 | 9/2004 | Sood et al. | |
| 6,841,839 | B2 | 1/2005 | Sridhar et al. | |
| 6,872,902 | B2 | 3/2005 | Cohn et al. | |
| 6,876,482 | B2 * | 4/2005 | DeReus | 359/290 |
| 7,242,273 | B2 * | 7/2007 | Isobe et al. | 335/78 |
| 2002/0171144 | A1 | 11/2002 | Zhang et al. | |

FOREIGN PATENT DOCUMENTS

| | | |
|---|---|---|
| JP | 57-121255 | 7/1982 |
| JP | 61110441 | 5/1986 |
| WO | WO98/09312 | 3/1998 |
| WO | WO99/17322 | 4/1999 |
| WO | WO99/21204 | 4/1999 |

OTHER PUBLICATIONS

Cohn, M.B., "Wafer-to-Wafer Transfer of Microstructures for Vacuum Packaging," in Technical Digest: 1996 Solid State Sensor and Actuator Workshop, Hilton Head Island, S.C., 1996, pp. 32-35.

Maharbiz, M. M., "Batch Micropackaging by Compression-Bonded Wafer-Wafer Transfer," Proceedings of 12th International Workshop on Micro Electro Mechanical Systems (MEMS 1999), Orlando, Fl, USA, Jan. 17-21, 1999, pp. 482-489.

PCT International Search Report, International Application No. PCT/US01/45132, Sep. 23, 2002.

PCT Written Opinion, International Application No. PCT/US01/45132, Feb. 25, 2003, 4 pages.

Sakata, M. et al., "Micromachined relay which utilizes single crystal silicon electrostatic actuator," Proc. IEEE MicroElectroMechanical Systems: MEMS-99, pp. 21-24, Orlando, Florida, USA, Jan. 1999.

Singh, A. et al., "Batch Transfer of Microstructures Using Flip-Chip Solder Bump Bonding," International Conference on Solid State Sensors and Actuators, TRANSDUCERS '97, Chicago, 1997, Jun. 16-19, 1997 pp. 265-268, vol. 1.

* cited by examiner

HIGH FORCE MEMS DEVICE

CROSS-REFERENCE TO RELATED APPLICATIONS

This application claims the benefit of U.S. Provisional Application No. 60/679,817, filed on May 12, 2005, entitled "MEMS device," the entire disclosure of which is hereby incorporated by reference herein in its entirety for all purposes.

STATEMENT REGARDING FEDERALLY SPONSORED RESEARCH OR DEVELOPMENT

This invention was made with Government support under Contract No. FA9453-04-C-0030 awarded by the U.S. Air Force, an AFRL Contract No. F33615-03-1-7002, and also under Subcontract 560500P412486 with Northeastern University. The Government has certain rights in the invention.

BACKGROUND OF THE INVENTION

1. Field of the Invention

This invention pertains in general to MEMS device, and more specifically to an improved cantilever design for usage in a MEMS device 2. Description of the Related Art Traditionally, many MEMS devices are actuated by simple, single-stage cantilevers, which are composed of a cantilever plate, a moveable contact and a stationary contact. When a typical metal-metal contact MEMS switch is turned on, the cantilever plate is actuated until the moveable contact and the stationary contact achieve closure, and this closure is typically achieved in a single stage of movement of the cantilever plate (e.g., a hinge on the device allows the plate to be lowered in one movement). When the device is turned off, the moveable and stationary contact interface is broken as these two contacts are separated, and the device reassumes the open state. MEMS switch devices are important for use in various types of applications. For example, they can be used in mobile phones for switching RF signals between transmit and receive modes and other related functions, micro-relays that can be used in automated test equipment (ATE), phased radar array, and other applications. MEMS switch configurations include but are not limited to SPST, SPDT, SP4T, DPDT, SP7T and SP8T. MEMS switches can be used for DC and RF applications.

For long-term reliability of switches such as contact switches and other MEMS cantilever devices, this "simple" cantilever structure does not adequately provide the actuation forces necessary to overcome stiction/adhesion forces, such as those caused by welding, electrical charging and device contamination. For many MEMS applications, especially those requiring a high quality interface between the contact surfaces, such as MEMS switches, this may be detrimental to reliability and device lifetime. Without a sufficiently strong force, the two contacts may never achieve full closure. Further, the single-stage cantilever design commonly only allows for a small gap between contacts before closure, thus resulting in inferior isolation.

In addition, the lifetime of a MEMS switch device can be greatly decreased due to the manner in which the two contacts are brought together and then pulled apart. If the first contact is brought down too rapidly and if it does not contact the other contact in a sufficiently gentle manner, this can result in damage to the device that over a period of time can reduce the overall life of the device. Similarly, if the contacts are pulled straight apart from each other and in a manner that is not sufficiently gentle, this can again cause unwanted damage to the contacts, decreasing the life of the device.

Another issue in single-stage cantilevers is the increase in resistance due to contaminant build-up and other particulates interfering with contact closure. Many single-stage cantilevers do not have any mechanism for removing this type of build-up on the contact surface. Single-stage cantilevers commonly also have low actuating forces, and so they may not have the adequate measures for removing the contamination or otherwise providing a mechanism for removal. Thus, again, these types of single-stage cantilever devices may suffer from shortened lifetimes.

Therefore, there is a need in the art to for a MEMS device with cantilever actuator that provides more long-term reliability, provides the higher actuation forces necessary to overcome stiction or adhesion forces, provides a sufficiently large gap for improved isolation, provides better interface quality that includes fewer contaminants, and provides a mechanism for more gentle, easier contact closure and separation.

DISCLOSURE OF INVENTION

The above need is met by a MEMS device with a two-stage cantilever design. The device includes a substrate with a stationary contact affixed thereto, an anchor affixed to the substrate, and a torsion arm affixed to the anchor by a first torsion hinge with a first axis. The device further includes a cantilever plate with a moveable contact affixed thereto in aligned confronting relation to the stationary contact. The cantilever plate is connected to the torsion arm by a second torsion hinge with a second axis. The first torsion hinge is adapted to rotate the cantilever plate about the first axis toward or away from the substrate in response to an actuating force and the second torsion hinge is adapted to rotate the cantilever plate about the second axis toward or away from the substrate in response to the actuating force. This two-stage rotation results in movement of the moveable contact into contact with the stationary contact or separation of the moveable contact from the stationary contact. In some embodiments, the natural spring restoration force of the cantilever plate material, about the first axis and the second axis, can be used to reduce the impact force of the movable contact on the stationary contact, reducing damage and stiction of the contacts. In some embodiments, the natural mechanical spring restoration force of the cantilever plate material, about the first axis and the second axis, can be used to peel apart the cantilever plate and the movable contact from the substrate and the stationary contacts, reducing contact stiction.

In another embodiment, the invention includes a method for actuating a MEMS device described above. The method includes applying an actuating force to the MEMS device. Responsive to the actuating force, the cantilever plate is rotated about the first axis of the first torsion hinge toward the substrate. Also responsive to the actuating force, the cantilever plate is rotated about the second axis of the second torsion hinge toward the substrate. The rotation of the cantilever plate about the first and second axes moves the moveable contact into contact with the stationary contact.

In still another embodiment, the invention includes a method for separating contacts on the MEMS devices described above. The method includes reducing application of an actuating force applied to the MEMS device. Responsive to the reduced actuating force, the cantilever plate is rotated about the second axis of the second torsion hinge away from the substrate. Also responsive to the reduced actuating force, the cantilever plate is rotated about the first axis of the first torsion hinge away from the substrate. The rotation of the cantilever plate about the first and second axes separates the moveable contact from the stationary contact.

In yet another embodiment, the invention includes a MEMS device with a cantilever design, where the device comprises a first substrate with a stationary contact affixed thereto and a second substrate with an anchor affixed thereto. In this embodiment, the second substrate is in aligned confronting relation with the first substrate and the first and second substrates are bonded together. The device also includes a seal ring surrounding the bonded first and second substrates to hermetically seal the bonded substrates together to form a cavity between the bonded substrates. The device further includes at least one signal path that enters and exits the cavity formed between the bonded substrates using feedthroughs selected from a group consisting of: vias, lateral feedthroughs, and combinations thereof. In some embodiments, said signal paths and said feedthroughs are laid out to minimize RF transmission losses. In addition, the device comprises a torsion arm affixed to the anchor by a first torsion hinge with a first axis and a cantilever plate with a moveable contact affixed thereto in aligned confronting relation to the stationary contact. The cantilever plate is connected to the torsion arm by a second torsion hinge with a second axis. In some embodiments, the torsion arm and cantilever plate are substantially formed from silicon. The first torsion hinge is adapted to rotate the cantilever plate about the first axis toward or away from the substrate in response to an actuating force. The second torsion hinge is adapted to rotate the cantilever plate about the second axis toward or away from the substrate in response to the actuating force moving the moveable contact into contact with the stationary contact or separating the moveable contact from the stationary contact. In some embodiments, more than one anchor can be used. In some embodiments, such as a see-saw configuration, an additional actuator can be added to pull the two contacts apart.

The features and advantages described in this disclosure and in the following detailed description are not all-inclusive, and particularly, many additional features and advantages will be apparent to one of ordinary skill in the relevant art in view of the drawings, specification, and claims hereof. Moreover, it should be noted that the language used in the specification has been principally selected for readability and instructional purposes, and may not have been selected to delineate or circumscribe the inventive subject matter, resort to the claims being necessary to determine such inventive subject matter.

The figures depict an embodiment of the present invention for purposes of illustration only. One skilled in the art will readily recognize from the following description that alternative embodiments of the structures and methods illustrated herein may be employed without departing from the principles of the invention described herein.

DETAILED DESCRIPTION OF THE PREFERRED EMBODIMENTS

The two-stage cantilever design disclosed herein improves the reliability of MEMS with cantilever actuators by using a cantilever structure with a high actuation force, a scrubbing contact motion, and an unzipping motion for contact separation. In most single stage cantilevers, to have a reasonable gap for isolation purposes, most of the cantilever structure must be relatively distant from the substrate area with the applied voltage. With the two stage design, a substantial portion of the cantilever plate that is rotated about the second axis of the second torsion hinge can positioned to be extremely close to the substrate area with an applied voltage, thus providing a much higher electrostatic force while maintain a large gap. The higher pull-on forces associated with this invention provide better electrical contact in switches and relays. For devices such as MEMS switches, this translates into lower resistances and lower insertion losses, as well as greater power handling. In addition, a larger gap between the stationary and movable contacts can be implemented, which increases RF isolation and stand-off voltage, and decreases problems with capacitive coupling. In some embodiments, the scrubbing motion (e.g., the "scrubbing" of the moveable contact across the surface of the stationary contact, as described in more detail below) can improve the interface quality between contacts by removing at least some of the contaminants. Each cycle provides a more "fresh" contact surface, which improves contact resistance. When contact is broken between the stationary and movable contact surfaces, the invention provides a mechanism that combines both normal separation force and rotation. This creates a stress concentration at the contact edge, making the contacts easier to separate (e.g., through an unzipping or peeling apart action to separate the contacts, rather than a direct pulling apart of the contacts).

Figure 1:
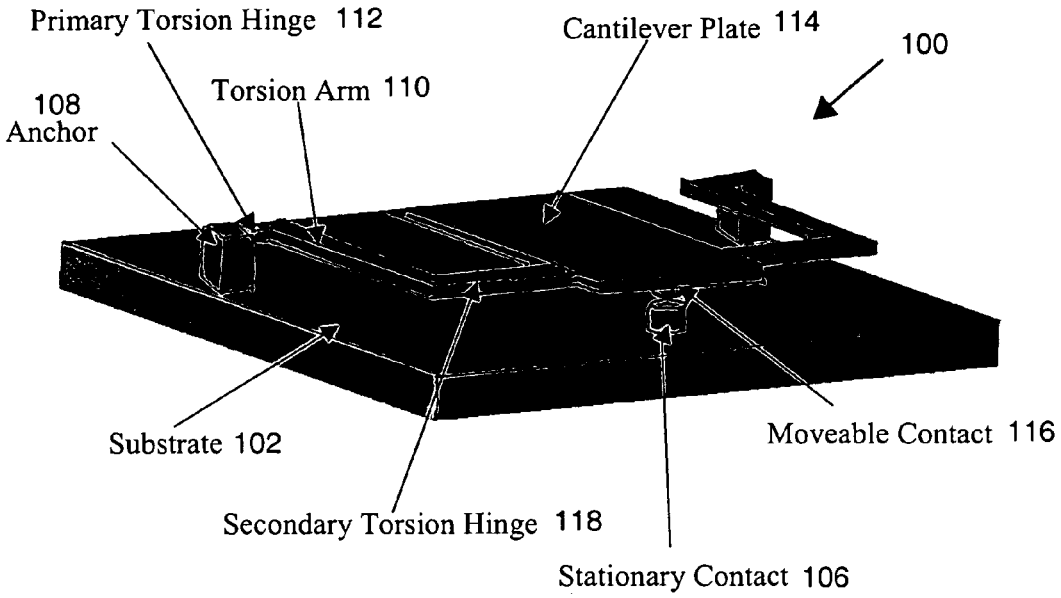
FIG. 1 is an isometric view of the MEMS device illustrating a substrate including various structures, according to one embodiment of the present invention.
Figure 2A:
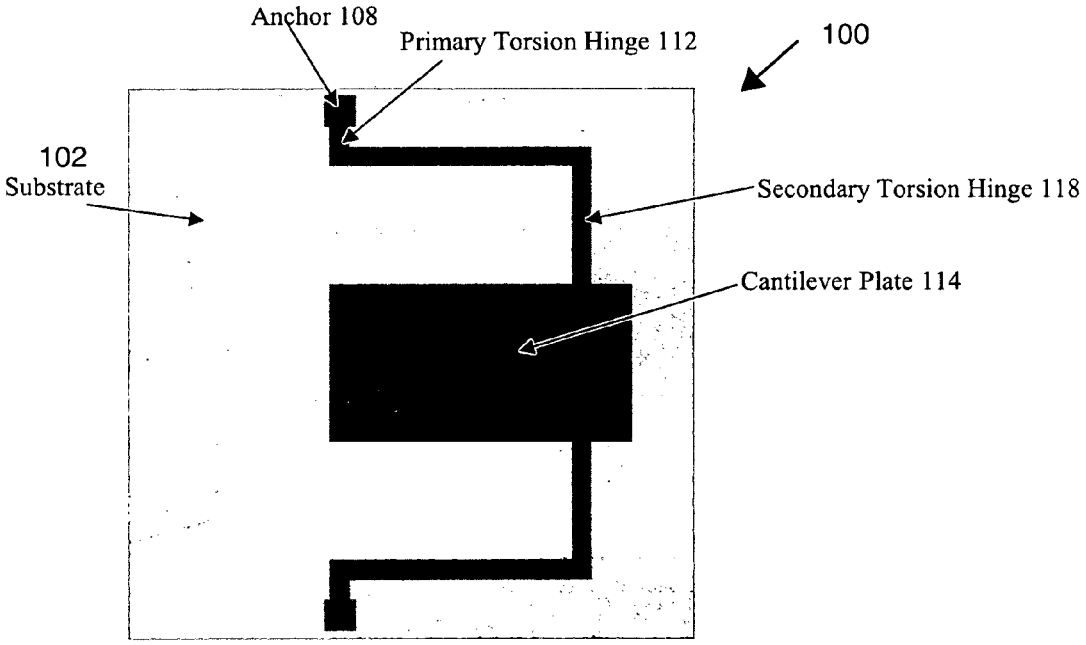
FIG. 2*a* is a top view of the MEMS device of FIG. 1, according to one embodiment of the present invention.

Referring now to FIGS. 1 and 2*a* there is shown a MEMS device 100 illustrating a substrate 102 including various structures, according to an embodiment of the present invention. The MEMS device 100 of FIG. 1 includes a substrate 102 with a cantilever 104 design affixed to the substrate 102. Affixed to the substrate 102 is a stationary contact 106 and an anchor 108. A torsion arm 110 is affixed to the anchor 108 by a first or primary torsion hinge 112 with a first axis. A cantilever plate 114 is connected to the torsion arm 110 by a second torsion hinge 118 with a second axis. A moveable contact 116 is affixed to the cantilever plate 114 in aligned confronting relation to the stationary contact 106. The device 100 is designed so that the primary torsion hinge 112 is adapted to rotate the cantilever plate 114 about the first axis toward the substrate 102 in response to application of an actuating force. In addition, the secondary torsion hinge 118 is adapted to rotate the cantilever plate 114 about the second axis toward the substrate 102 in response to the actuating force. These two hinges thus allow the cantilever plate 114 to be moved toward the substrate 102, thus moving the moveable contact 116 into contact with the stationary contact 106.

Upon reduction or removal of the actuating force, the secondary torsion hinge 118 allows rotation of the cantilever plate 114 about the second axis away from the substrate 102 and the primary torsion hinge 112 allows rotation of the cantilever plate 114 about the first axis away from the substrate 102. Thus, the moveable contact 116 is separated from the stationary contact 106.

Other embodiments of the MEMS device 100 can include other structures beyond those shown in FIGS. 1 and 2 (e.g., additional mechanical or electrical contacts, additional substrates, additional cantilever sections, etc.) and the structures of MEMS device 100 can be designed and arranged in manners that differ from the design/arrangement of FIGS. 1 and 2 (e.g., the device 100 could include only one torsion arm 110, anchor 108, and hinges 108, 112, instead of two of each of these structures, or alternatively could include numerous hinges to allow the cantilever plate to be rotated in different manners).

With regard to fabrication of the MEMS device 100, the substrate 102 is preferably made of semiconductor or dielectric material, although one of ordinary skill in the art would recognize the different types of metals and various combinations of materials that can also be used, including but not limited to metals such as gold and nickel. The anchor 108, torsion arm 110, cantilever plate 114 and moveable contact 116 can be formed on the substrate 102. The stationary contact 106 is affixed to the substrate 102 preferably using standard semiconductor processes known to those of skill in the art (e.g., CMOS). The anchor 108, torsion arm 110, and cantilever plate 114 can be fabricated as a monolithic structure. In some embodiments, the cantilever parts such as the torsion arm 110 and cantilever plate 114 are patterned out of a single layer of material, such as the top single crystalline silicon layer of a silicon-on-insulator substrate etched by plasma etching or DRIE. In some embodiments, however, these structures are fabricated separately. The moveable contact 116 can also be fabricated using standard semiconductor processes known to those of skill in the art (e.g., CMOS). In some embodiments, the length, width, and thickness of the primary 112 and secondary torsion hinges 116 are chosen so that the latter is somewhat stiffer than the former, thus ensuring that the initial motion that moves the cantilever plate 114 toward the substrate 102 occurs at the primary torsion hinge 112. Various actuation means can be used, including but not limited to electrostatic, thermal, piezo, shape-memory, magnetic, and any combination. In an electrostatic actuation embodiment, the torsion hinge 112, 116 dimensions, along with the cantilever plate 114 area and actuation gap are chosen to provide the desired contact force and threshold potential. For example, electrostatic actuation voltage may range but is not limited to 10 volts to 200 volts. As another example, the torsion hinge, cantilever plate area may be sized to provide high actuation forces. Many current MEMS switches have up to several hundred micronewtons of actuation force. Ideally, greater pull-down and restoration forces are available, for example greater than 1 milli-newton, 5 milli-newton, etc.

Some standard fabrication processes that could be used with the present invention are discussed in more detail in U.S. patent application Ser. No. 11/088,411, filed on Mar. 23, 2005, "MEMS Device with Integral Packaging," which is a continuation of U.S. Pat. No. 6,872,902, filed on Jun. 27, 2003, entitled "MEMS Device with Integral Packaging," which is a continuation of U.S. patent application Ser. No. 09/997,671, filed on Nov. 28, 2001, entitled "MEMS Device with Integral Packaging" (now abandoned) and which claims the benefit of U.S. Provisional Application Ser. No. 60/253,851, filed on Nov. 29, 2000, each of which is incorporated by reference herein in its entirety for all purposes.

The mechanical elements of device 100 (such as the anchor 108, torsion arm 110 and cantilever plate 114) are preferably fabricated out of silicon, and even more preferably out of the top single crystalline silicon layer of a silicon on insulator (SOI) substrate/wafer. However, other materials can also be used for these mechanical structures, including but not limited to polysilicon, doped silicon, silicon germanium, metals (such as gold and nickel), dielectrics, ceramic, and any combination thereof.

Contact materials used for moveable contact 116, stationary contact 106 and any other contacts included on device 100 include, but are not limited to, gold, harden gold, gold nickel alloys, gold-cobalt alloys, platinum family metals, such as ruthenium, platinum, iridium, rhodium, conductive metal oxides, such as ruthenium oxide, tungsten, rhenium, carbon, and various stacks, combinations and alloys. Contacts can also be made out of several layers, such as gold on ruthenium, gold-nickel (e.g., 1-5% nickel preferably 1.5-2% nickel), gold-nickel (e.g., 1-5% nickel preferably 1.5-2% nickel) on ruthenium, gold-cobalt (e.g. less than 2% cobalt) on ruthenium, ruthenium oxide on ruthenium (e.g., formed by oxidizing ruthenium surface or by deposition of Ruthenium oxide).

Figure 2B:
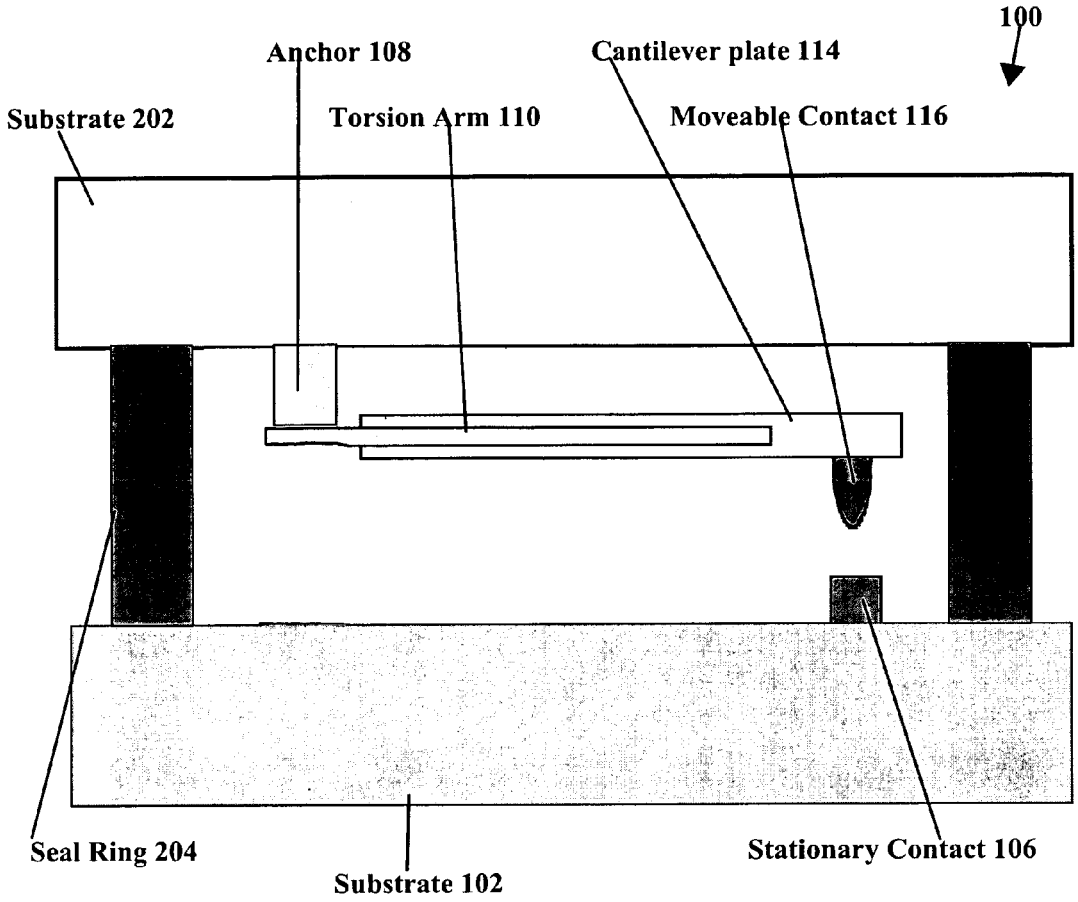
FIG. 2*b* is a side view of the MEMS device of FIG. 1 including a second substrate, according to one embodiment of the present invention.

The anchor 108, torsion arm 110, and cantilever plate 114 may be fabricated on the substrate 102 shown in FIGS. 1 and 2*a*, or alternatively be fabricated on a different substrate, as shown in the embodiment illustrated in FIG. 2*b*, which includes a side view of the MEMS device 100 with two substrates, the first substrate 102 and the second substrate 202. Thus, the device could include two separate substrates 102, 202. Examples and figures illustrating micro-switch devices with two separate substrates can also be found in the above-listed patents (e.g., in FIGS. 2*a* through 6*b* in those patents), including in U.S. patent application Ser. No. 11/088,411, filed on Mar. 23, 2005, "MEMS Device with Integral Packaging," and U.S. Pat. No. 6,872,902, filed on Jun. 27, 2003, entitled "MEMS Device with Integral Packaging," each of which is incorporated by reference herein in its entirety for all purposes.

A two-substrate design as shown in FIG. 2*b* and also shown in the two above-stated patents incorporated by reference can be used with the present invention to form a two-substrate MEMS device 100 with the substrate 102 and with a second substrate 202. If there are separate substrates, the two substrates 102, 202 may be held in aligned confronting relation with each other by various means, including but not limited to bonding, bonding with mechanical stop layers (preferably patterned by semiconductor fabrication processes such as lithography, CVD and etching) for gap control, mechanical fixturing, or combinations thereof (see e.g., FIG. 2*b* showing bonded substrates). Substrate bonding can be also performed by various other means including, but not limited to, gold thermocompression bonding, gold cold welding, cold welding, metal thermocompression bonding, anodic bonding, glass frit bonding, solder bonding/sealing, adhesive bonding, bonding with crush gasket made of metals, ceramic, and various combinations thereof. The bonding can be done on a wafer scale or at least in batch (e.g., to reduce cost), or in some cases, one or several at a time.

If the MEMS device 100 is fabricated by bonding at least two substrates 102, 202 together, seal rings can also be provided around the device(s) to provide sealing of the devices to prevent contamination, moisture, etc. from contacting the device and hindering its functioning. A seal ring 204 is illustrated on either side of the cantilever design in the embodiment shown in FIG. 2*b*. These seal rings 204 seal together the first substrate 102 and the second substrate 202. The sealing is preferably hermetic sealing in the case of MEMS switches. Hermetic sealing can also seal in the appropriate ambient conditions for the various devices. For example, ambient conditions, such as nitrogen, SF6, clean room air, helium, argon, oxygen and other gases can be used for some devices. Other devices may require vacuum or other combinations of conditions to be sealed in with the MEMS device for effective functioning. The choice of ambient conditions depends greatly on the device. For switches, the choice of contact material is important for the selection of ambient conditions. For example, in devices including contacts made from materials in the platinum family, ambient conditions that include nitrogen and argon gases may be less desirable since they can keep the contact metal oxidized and passive (e.g., contacts with conductive oxides), and thus less able to catalyze organic reactions. For example, in devices with contacts containing nickel, cobalt or another material that may form an insulating oxide on the contact surface, ambients that can oxide the contact surface may not be desirable as they may increase contact resistance. Examples of various sealing methods, including seal rings, hermetic sealing methods, etc. are described in detail in the above-stated patents, including in U.S. patent application Ser. No. 11/088,411, filed on Mar. 23, 2005, "MEMS Device with Integral Packaging," and U.S. Pat. No. 6,872,902, filed on Jun. 27, 2003, entitled "MEMS Device with Integral Packaging," each of which is incorporated by reference herein in its entirety for all purposes.

There are various feedthroughs for signal paths into and out of the sealed cavities including thru wafer vias through either substrate, lateral feedthroughs with electrically-insulating layers between one substrate and its sealing layer, or any combination. In one embodiment, one substrate is thinned from hundreds of microns in thickness to between 1 micron to 50 micron in thickness to improve RF performance and reduce size. Examples of various feedthroughs, such as vias or lateral feedthroughs, are described in detail and illustrated in the figures of the above-stated patents, including in U.S. patent application Ser. No. 11/088,411, filed on Mar. 23, 2005, "MEMS Device with Integral Packaging," and U.S. Pat. No. 6,872,902, filed on Jun. 27, 2003, entitled "MEMS Device with Integral Packaging," each of which is incorporated by reference herein in its entirety for all purposes.

In another embodiment of the device 100, the device 100 includes a particularly thick cantilever or high aspect cantilever for high force actuators. The thick/high-aspect structures can handle high forces without breaking or significantly flexing. These types of thick/high-aspect cantilevers are preferably made from silicon, or single crystalline silicon, such as that of the top silicon layer of a SOI wafer. These thick cantilevers can be fabricated out of other materials, such as other semiconducting materials, polysilicon, epi-polysilicon, silicon germanium, single crystal materials, polycrystalline materials, metals, ceramics, alloys, or combinations thereof. Thick cantilevers are preferably at least 5 microns thick, or at least 10 microns thick.

Referring now to FIG. 3, there is shown a more detailed view of the device illustrating its operation, according to an embodiment of the present invention. In addition, in FIG. 4*a*, there is shown a flow chart illustrating an embodiment for actuating the MEMS device 100 and for separating the contacts 106, 116.

With regard to actuating the MEMS device 100, the method includes applying 402 an actuating force to the MEMS device. The preferable mechanism for actuation of the device 100 is electrostatic actuation. However, other actuation mechanisms include, but are not limited to, electromagnetic (such as the Magfusion RF MEMS switch), thermal, electrothermal, shape memory alloy, piezo and any combination thereof. Some of these other actuation mechanisms may be combined with latching mechanisms, such as an electrostatic latch and also a mechanical latch. Examples of mechanisms for applying an actuating force, including figures illustrating an actuator associated with a micro-switch device, are described in detail in the above-stated patents, including in U.S. patent application Ser. No. 11/088,411, filed on Mar. 23, 2005, "MEMS Device with Integral Packaging," and U.S. Pat. No. 6,872,902, filed on Jun. 27, 2003, entitled "MEMS Device with Integral Packaging," each of which is incorporated by reference herein in its entirety for all purposes. For example, contact(s) can be arranged so that they are in electrical contact with a signal path (e.g., a metal trace or strip that serves as a path for signals propagating through the micro-switch), so that when the actuator is activated by being supplied with a drive voltage to establish a field (e.g., electric or magnetic field), the field provides a force that pulls the cantilever plate 114 downward toward the substrate 102 to close the gap between the contacts 116, 106. In this "activated" state, a signal launched into the signal path can propagate through the micro-switch due to the bridged gap provided by the contacts 116, 106 that are no longer separated. This process is illustrated in more detail in the figures of the above-stated patents that are incorporated by reference. In another embodiment, the switch can be configured as a capacitive switch or a shunt switch by for example, but not limited to, reconfiguring, adding appropriate dielectric layers, or some combination.

Figures 3A, 3B, 3C, 3D, 3E:
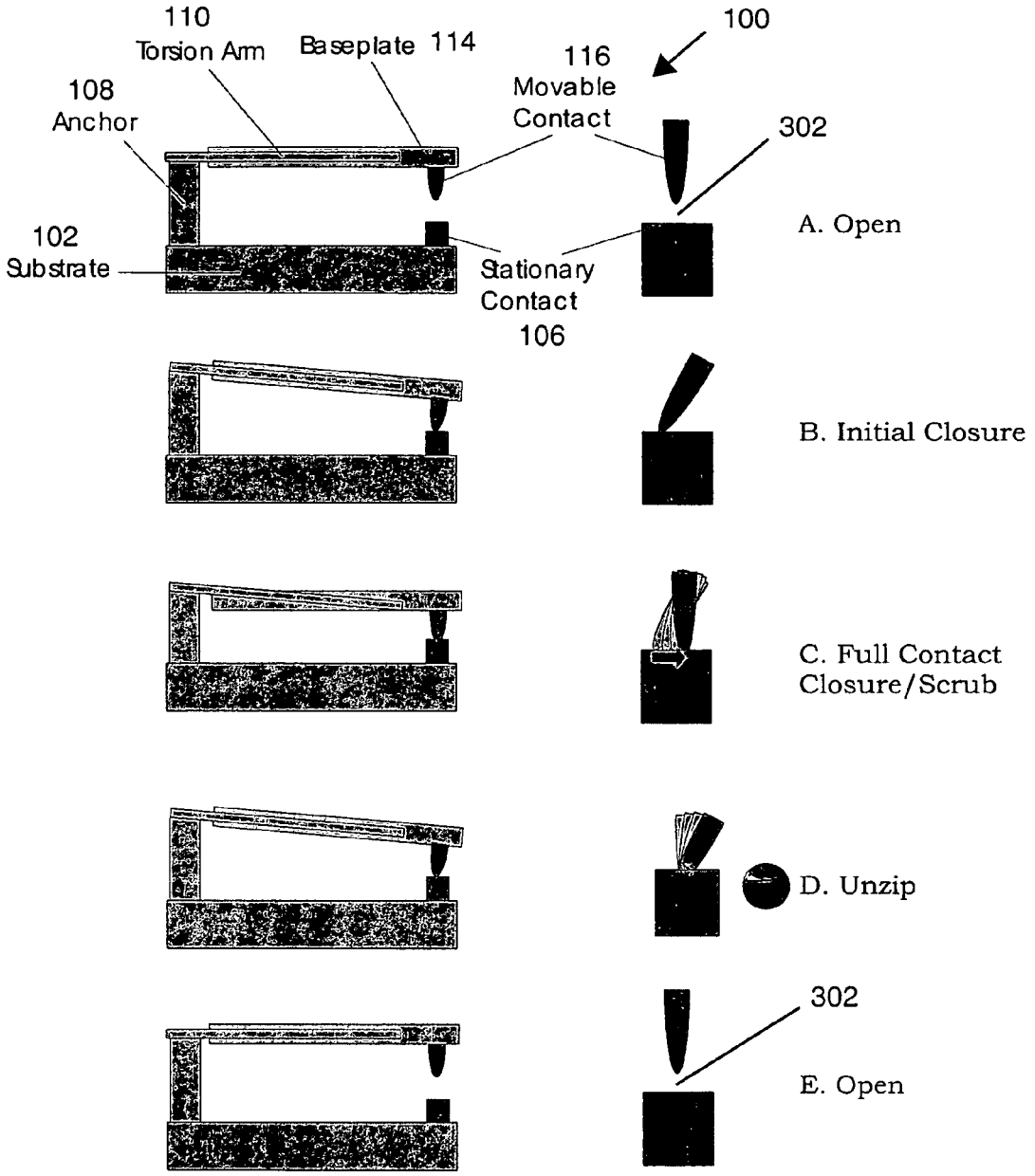
FIG. 3*a* is a side view of the actuating mechanism of the cantilever in an open state, according to one embodiment of the present invention.
FIG. 3*b* is a side view of the actuating mechanism of the cantilever in an initial closure state, according to one embodiment of the present invention.
FIG. 3*c* is a side view of the actuating mechanism of the cantilever in a full contact or scrub state, according to one embodiment of the present invention.
FIG. 3*d* is a side view of the actuating mechanism of the cantilever in an unzipping state, according to one embodiment of the present invention.
FIG. 3*e* is a side view of the actuating mechanism of the cantilever returned to the open state, according to one embodiment of the present invention.
Figure 4A:
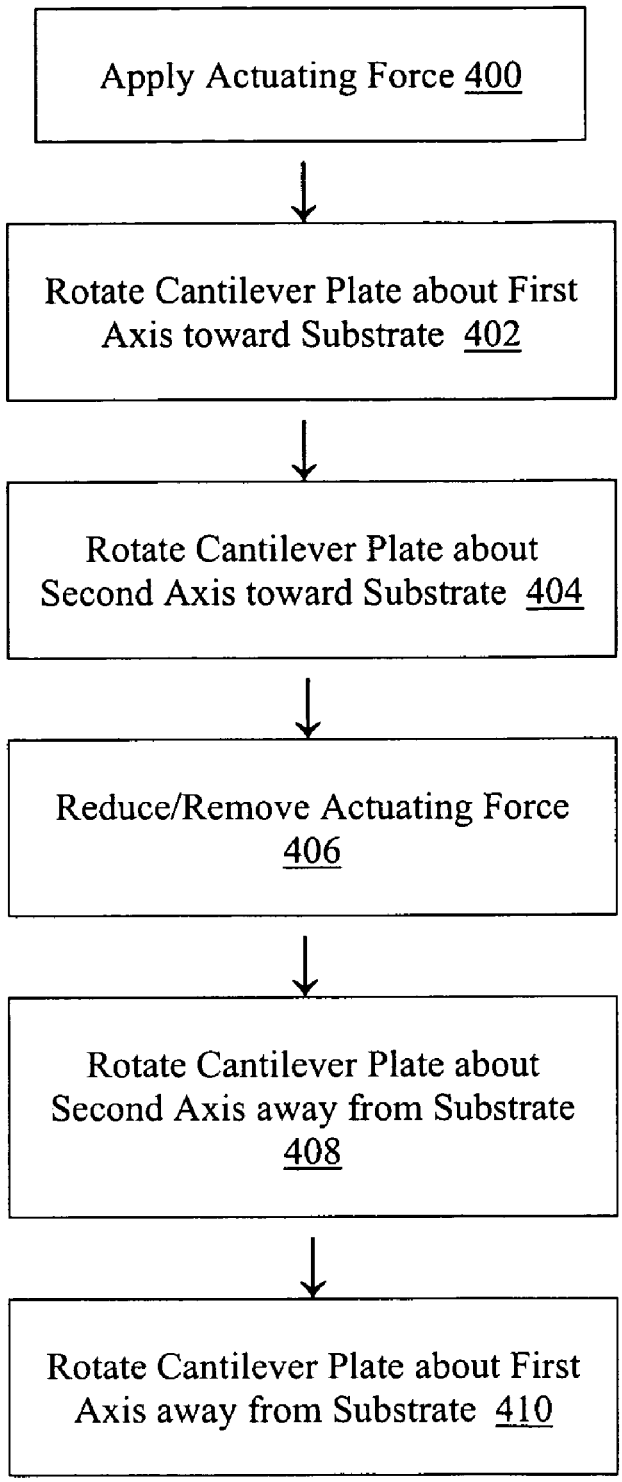
FIG. 4*a* is a flow chart illustrating the operation of the MEMS device, according to one embodiment of the present invention.
Figure 4B:
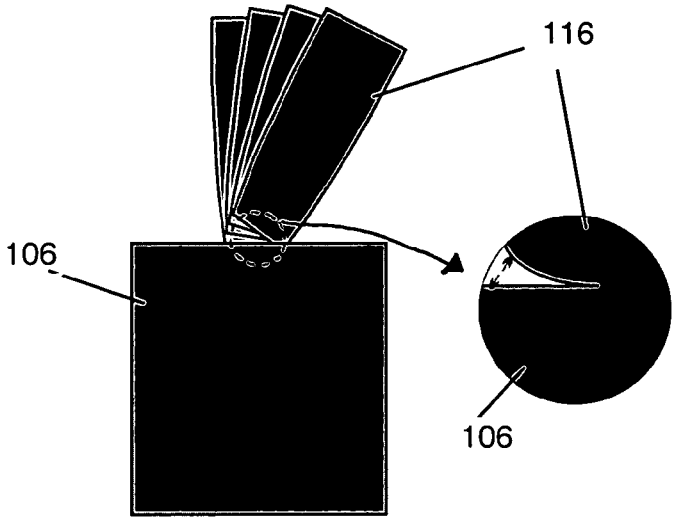
FIG. 4*b* is a more detailed view of the actuating mechanism of the cantilever in during the unzipping process, according to one embodiment of the present invention.

FIG. 3*a* includes a side view of the actuating mechanism of the cantilever in an open state. Initially the stationary 106 and moveable 116 contacts are separated (see gap 302), and the base plate or cantilever plate 114 is in a generally horizontal position and is generally parallel to the substrate 102. The gap 302 between the moveable contact 116 and the stationary contact 106 during this open state may be submicron to many microns.

FIG. 3*b* shows the actuating mechanism of the cantilever in an initial closure state. Responsive to the application 400 of an actuating force (such as the forces described above), the cantilever plate 114 is rotated 404 about the first axis of the primary torsion hinge 112 toward the substrate 102. In some embodiments, when it is desired to bring the stationary 106 and moveable 116 contacts together, the electric potential of the cantilever plate 114 is raised, relative to the substrate 102. As the potential is raised, the cantilever plate 114 will rotate 404 downward about the axis of the primary torsion hinge 112, as shown in FIG. 3*b*. Thus, applying an actuating force can include the raising of the electric potential of the cantilever plate 114 relative to the substrate 102. As shown in FIG. 3*b*, the cantilever plate 114 is no longer parallel to the substrate 102 as it was in the open state of FIG. 3*a*, but instead the cantilever is sloped downward at an angle so that the end of the cantilever plate 114 with the moveable contact 116 is moved closer to the substrate 102. In some embodiments, the moveable contact 116 is just lightly touching the surface of the stationary contact 106 in this initial closure state. In other embodiments, the contacts 116, 106 are not quite touching. In some embodiments, the moveable contact 116 is at an angle to the stationary contact 106 so that only an edge or a portion of a surface of the moveable contact 116 is touching the stationary contact 106.

FIG. 3*c* shows the actuating mechanism of the cantilever in a full contact or "scrub" state. Responsive to the application 400 of the actuating force, the cantilever plate 114 is rotated 406 about the second axis of the secondary torsion hinge 118 toward the substrate 102. The actuating force that causes this second stage of rotation 404 may be the same actuating force that caused the first stage of rotation 402 (e.g., rotation about the first axis) or a different actuating force (or even a different type of force). In some embodiments, the same actuating force causes both stages of the rotation 402, 404. In some embodiments, the force is increased during the second stage of the rotation 404. For example, in some embodiments, the electrical potential of the cantilever plate 114 relative to the substrate 1.02 is raised (as described above) to cause the rotation 402 about the first axis. Then, the electric potential of the cantilever plate 114 relative to the substrate 102 is further raised to rotate 404 the cantilever plate 114 downward about the second axis of the secondary torsion hinge 118. In some embodiments, the cantilever plate 114 is again generally parallel to the substrate 102, as in FIG. 3*a*, but the cantilever plate 114 is lowered so as to be closer to the substrate 102 due to the two stages of rotation 402, 404. In some embodiments, the moveable contact 116 is now fully contacting the stationary contact 106, as shown in FIG. 3*c* (as opposed to only lightly touching or not quite touching in the initial closure state). In some embodiments, the moveable contact 116 is no longer sitting at an angle to the stationary contact 106 due to the second stage of rotation 404

In some embodiments, the second stage of rotation 404 that brings the contacts 106, 116 into a state of full contact induces a scrubbing motion of the moveable contact 116 across the stationary contact 106, as shown in FIG. 3*c*. This motion creates a full contact closure by sliding a surface the moveable contact 116 across the surface of the stationary contact as the cantilever plate 114 is being further lowered toward the substrate 102 in the second stage of rotation. This scrubbing motion can help remove contaminant layers and/or particulates present, between the stationary 106 and moveable 116 contacts (e.g., by using the sliding action of the moveable contact 106 to scrub off the contaminants from one or both contacts 106, 116).

This two-stage rotation design can allow the device 100 to have a larger gap 302 initially since the plate 114 can rotate down to the substrate 102 in two stages, rather than just relying on the rotation of the first stage to bring the contacts 106, 116 together. This provides high isolation for cell phones and other wireless applications and high voltage applications. With the two stage rotation, the plate 114 can also be brought down more gently rather than being slammed down in one movement. This may lengthen the lifetime of the device and minimizing contact 106, 116 damage. In some embodiments, the actuation force that can be applied can be stronger overall (e.g., increased by factor of four relative to single-stage cantilevers), since the device 100 can be actuated in two stages and the cantilever plate and other cantilever sections can be lowered closer to the substrate 102, increasing actuation force. In addition, the two-stage design can allow the device 100 to be turned on and off more quickly and easily. In one embodiment, larger forces are applied to quickly close the switch. The impact force can be greatly reduced with the two-stage design. This approach can take advantage of squeeze film damping effects that are greatly dependent upon the gap. As those skilled in the art are aware, the squeeze film damping effect can be further increased by reducing the gap. Some embodiments reduce the gap by adding one or more structures on the cantilever or the substrate.

FIG. 3*d* shows the actuating mechanism of the cantilever embodiment in an unzipping state. To separate the contacts 106, 116, the application of the actuating force applied to the MEMS device is reduced or removed 406. For example, the electric potential of the cantilever plate 114 relative to the substrate 102 can be lowered. Responsive to the reduced 406 actuating force, the cantilever plate 114 is rotated 408 about the second axis of the secondary torsion hinge 118 upward and away from the substrate 102 (e.g., in a first stage of rotation to move to cantilever plate 114 upward). The cantilever plate 114 is thus returned to a sloped position relative to the substrate 102, similar to the position shown in FIG. 3*b*. This angular movement "unzips" (e.g., peels apart) the moveable 116 and stationary 106 contacts. This unzipping is illustrated in more detail in FIG. 4*b*, where the moveable contact 116 is shown to roll onto its edge at an angle to the stationary contact 106 so that only a small portion of the surface of the moveable contact 116 is touching the stationary contact 106. Thus, rather than being quickly separated from the full closure position to tear the contacts 116, 106 apart from each other, the moveable contact 116 is peeled away in stages from the stationary contact 106, leaving only a part of the moveable contact 116 still touching the stationary contact 106. This allows for a more gentle and less damaging separation, and less force is required to separate the contacts 106, 116 when unzipped in this manner.

FIG. 3*e* shows the actuating mechanism of the cantilever embodiment returned to an open state. Responsive to the reduced 406 actuating force, the cantilever plate 114 is rotated 410 about the first axis of the primary torsion hinge 112 away from the substrate 102, wherein the rotation of the cantilever plate 114 about the first and second axes separates the moveable contact 116 from the stationary contact 106. In some embodiments, this second stage of rotation 410 to move the cantilever plate 114 upward occurs as the electric potential of the cantilever plate relative to the substrate is further reduced (e.g., beyond the reduction that occurred for the first stage of rotation). The cantilever plate 114 and torsion arm 110 come back to a generally parallel alignment with the substrate 102 and the contacts 106, 116 are again in the open state.

Those skilled in the art will recognize that other actuation designs can be used to replace the electrostatic actuation design. For example, it is possible to include other appropriate materials in the device 100, such as NiFe for some magnetic actuated switches, piezo materials for piezo switches, bimorphs or other more complex designs for thermal switches, and shape memory alloys for shape memory alloy based switches, to modify the actuation method. In addition, the device can be modified in various ways. For example, the contacts can be shaped differently than those shown in the Figures (e.g., cylindrical-shaped, square-shaped, circular, etc.) As another example, an additional mechanical, non-electrical contact (or multiple additional contacts) may be added to the cantilever plate 114, adjacent to the moveable contact 116 (e.g., located on the cantilever plate 114 on the inside of the moveable contact 116 in between the moveable contact 116 and the primary torsion hinges 112, but nearest to the moveable contact 116). This additional contact can help to prevent direct contact between the cantilever plate 114 and the substrate 102, thus helping to prevent a short circuit. For example, the additional contact can be sufficiently long (e.g., longer than the moveable contact 116, or possibly as long as the moveable contact 116 plus the stationary 106 contact) to contact the substrate 102 to stabilize the cantilever plate 114 before the plate 114 would have a chance to touch the substrate 102. In addition, the additional contact can help to maintain at least an approximately parallel gap between the cantilever plate 114 and the substrate 102 when the plate 114 is in the fully lowered position (FIG. 3C).

Applications for the MEMS device 100 include, but are not limited to, phase shifters, reconfigurable antenna, tunable filters, antenna switches, reconfigurable circuits, variable capacitors, variable capacitor banks, switch matrices, DSL switch matrices for facilitating DSL provisioning. These components are important for many systems, including but not limited to cell phone, WLAN, satellite communications, satellite communication antenna, DSL (particularly provisioning and testing), radar, military radios, relays for Automated Test Equipment, and high-power relays.

Figures 5A, 5B, 5C, 5D, 5E:
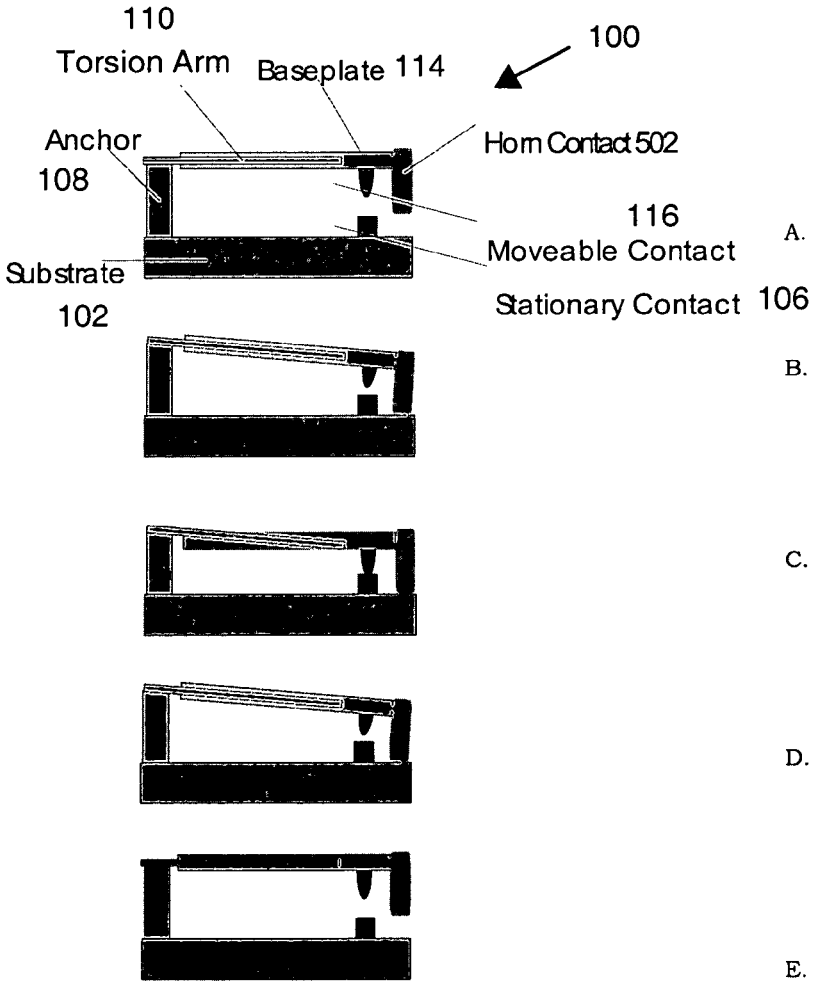
FIG. 5*a* is a side view of another embodiment of the actuating mechanism of the cantilever including a horn contact in an open state.
FIG. 5*b* is a side view of another embodiment of the actuating mechanism of the cantilever including a horn contact in an initial closure state.
FIG. 5*c* is a side view of another embodiment of the actuating mechanism of the cantilever including a horn contact in a full contact or scrub state.
FIG. 5*d* is a side view of another embodiment of the actuating mechanism of the cantilever including a horn contact in an unzipping state.
FIG. 5*e* is a side view of another embodiment of the actuating mechanism of the cantilever including a horn contact returned to the open state.

Referring now to FIG. 5, there is shown a side view of another embodiment of the actuating mechanism of the cantilever including a horn contact 502. In some embodiments, the horn contact may serve as a mechanical contact and not an electrical contact. FIGS. 5*a* through 5*e* are similar to FIGS. 3*a* through 3*e*, except for the addition of the horn contact 502. In some embodiments, the horn contact 502 is affixed to the cantilever plate 114 at its edge, adjacent to the moveable contact 116 (but on the outside of the moveable contact 116). In some embodiments, this horn contact 502 is shaped like a horn, as shown in the figures. In other embodiments, the horn contact 502 has a different shape (e.g., similar to the shape of the moveable 116 and/or stationary 106 contacts, or another shape). The horn contact 502 can be useful in increasing the mechanical restoring force, and thus increasing the lifetime of the device 100 and enabling higher mechanical frequency. The operation of the device shown in FIG. 5 is similar to that of device 100 shown in FIG. 3. Thus, the methods shown in the flowchart of FIG. 4 are referred to below, as well. For the device in FIG. 5 and other embodiments, the two-stage mechanism also enables large forces while maintaining large gaps for good isolation. Furthermore, the squeeze film effects also apply to the device in FIG. 5 as well as to other embodiments.

FIG. 5*a* shows the device embodiment in an open state. When the cantilever is actuated 400, contact is achieved between the horn contact 502 and the substrate 102 (FIG. 5*b*). In some embodiments, this contact by the horn contact 502 occurs before contacts 106, 116 touch (thus the horn contact 502 can help to initially stabilize the device 100 and absorb some of the shock as the contacts 106, 116 come together), while in other embodiments, contact 106, 116 may touch each other at the same time that the horn contact 502 touches the substrate 102 or a little before. In some embodiments, this first stage of rotation 402 of the cantilever plate 114 about the first axis brings the moveable contact 116 into contact with the stationary contact 106 (e.g., as in FIG. 3*b*), while in other embodiments, the contacts 116, 106 are not quite touching after the first stage of rotation 402. As the device 100 continues to actuate, the cantilever plate 114 can rotate 404 about the second axis of the secondary torsion hinge 118 (FIG. 5*c*) with the axis about the horn contact 502 providing an additional movement. Thus, the plate 114 can rotate about the first axis and the horn contact 502 axis simultaneously. In some embodiments, the cantilever actuates until contact is achieved between the moveable 116 and stationary 106 contacts. In some embodiments, as the cantilever plate 114 is rotated, the scrubbing motion of the moveable contact 116 across the stationary contact 106 can occur and may still be ongoing.

To separate the contacts 106, 116, the actuating force is reduced/removed 406 (e.g., the potential is lowered), rotating the cantilever plate 114 upward about the axis of the secondary torsion hinge 118 back to at least approximate parallel alignment with the torsion arm 110 (FIG. 5*d*), with the axis about the horn contact 502 providing an additional movement. The horn contact 502 also provides some leverage for separation of contacts 106, 116 (e.g., by acting as a fulcrum that can be balanced upon to achieve easier separation). In some embodiments, the unzipping motion can occur between contacts 106, 116. Finally, the cantilever plate 114 and torsion arm 110 come back to at least approximate parallel alignment with the substrate 102 (e.g., as the potential is further reduced) and the contacts 106, 116 are again in the open state (FIG. 5*e*).

As will be understood by those familiar with the art, the invention may be embodied in other specific forms without departing from the spirit or essential characteristics thereof. Likewise, the particular naming and division of the components of the device, methodologies for use, and other aspects are not mandatory or significant, and the mechanisms that implement the invention or its features may have different names, divisions and/or formats. In addition, the components of the device can be modified in shape, size, composition materials, fabrication techniques, etc., and more components of different or the same type can be added. Furthermore, as will be apparent to one of ordinary skill in the relevant art, the components of the device, methodologies for use, and other aspects of the invention can be implemented in a number of different types of MEMS devices or different designs. From the above description, many variations will be apparent to one skilled in the relevant art that would yet be encompassed by the spirit and scope of the invention. Accordingly, the disclosure of the present invention is intended to be illustrative, but not limiting, of the scope of the invention, which is set forth in the following claims.

We claim:

1. A MEMS device with a cantilever design, the device comprising:

a substrate with a stationary contact affixed thereto;

an anchor affixed to the substrate;

a torsion arm affixed to the anchor by a first torsion hinge with a first axis; and a cantilever plate with a moveable contact affixed thereto in aligned confronting relation to the stationary contact, the cantilever plate connected to the torsion arm by a second torsion hinge with a second axis, the moveable contact positioned at an end of the cantilever plate adjacent to the second torsion hinge, wherein the first torsion hinge is adapted to rotate the cantilever plate in a first direction about the first axis toward or away from the substrate in response to an actuating force and the second torsion hinge is adapted to rotate the cantilever plate in a second direction opposite the first direction about the second axis toward or away from the substrate in response to the actuating force moving the moveable contact into contact with the stationary contact or separating the moveable contact from the stationary contact.

2. The device of claim 1, wherein the first torsion hinge is adapted to rotate the cantilever plate about the first axis toward the substrate in response to an increase in electric potential of the cantilever plate relative to the substrate and the second torsion hinge is adapted to rotate the cantilever plate about the second axis toward the substrate in response to a further increase in the electric potential moving the moveable contact into contact with the stationary contact.

3. The device of claim 1, wherein the second torsion hinge is adapted to rotate the cantilever plate about the second axis away from the substrate in response to an decrease in electric potential of the cantilever plate relative to the substrate and the first torsion hinge is adapted to rotate the cantilever plate about the first axis away from the substrate in response to a further decrease in the electric potential separating the moveable contact from the stationary contact.

4. The device of claim 1, further comprising a second substrate in aligned confronting relation with the substrate, wherein the anchor, torsion arm, first and second torsion hinges, and cantilever plate with moveable contact are formed on the second substrate instead of the substrate.

5. The device of claim 4, wherein the substrate and the second substrate are bonded together and the first and second torsion hinges are adapted move the cantilever plate on the second substrate toward or away from the stationary contact on the substrate.

6. The device of claim 4, wherein the substrate and the second substrate are bonded together and wherein the device further comprises a seal ring around the bonded substrates to hermetically seal the substrates together.

7. The device of claim 6, further comprising a signal path that enters and exits a cavity formed between the bonded substrates using feedthroughs selected from a group consisting of: vias, lateral feedthroughs, and combinations thereof.

8. The device of claim 1, wherein one or more of the anchor, torsion arm and cantilever plate are fabricated out of a material selected from a group consisting of: silicon, a top single crystalline silicon layer of a silicon on insulator substrate, polysilicon, doped silicon, silicon geranium, gold, nickel, dielectrics, ceramic, and combinations thereof.

9. The device of claim 1, wherein the actuating force is selected from a group consisting of: electrostatic, electromagnetic, thermal, electrothermal, shape memory alloy, piezo, and combinations thereof.

10. The device of claim 1, wherein at least one of the stationary and the moveable contact are fabricated out of a material selected from a group consisting of: gold, gold nickel alloy, platinum, ruthenium, iridium, rhodium, ruthenium oxide, tungsten, rhenium, carbon, and combinations thereof.

11. A method for actuating a MEMS device including a substrate with a stationary contact affixed thereto, an anchor affixed to the substrate, a torsion arm affixed to the anchor by a first torsion hinge with a first axis, and a cantilever plate with a moveable contact affixed thereto in aligned confronting relation to the stationary contact, the cantilever plate connected to the torsion arm by a second torsion hinge with a second axis, the method comprising:

applying an actuating force to the MEMS device;

responsive to the actuating force, rotating the cantilever plate in a first direction about the first axis of the first torsion hinge toward the substrate to move the moveable contact into contact with the stationary contact in a state of initial closure; and responsive to the actuating force, rotating the cantilever plate in a second direction opposite the first direction about the second axis of the second torsion hinge toward the substrate, wherein the rotation of the cantilever plate about the first and second axes moves the moveable contact into a state of full contact with the stationary contact.

12. The method of claim 11, wherein the MEMS device is a micro-switch.

13. The method of claim 11, wherein the state of initial closure further comprises a state in which the moveable contact is in contact with and positioned at an angle relative to the stationary contact.

14. The method of claim 11, wherein rotating the cantilever plate in a second direction further comprises rotating the cantilever plate into a position in which the cantilever plate is parallel to the substrate.

15. The method of claim 11, wherein rotation of the cantilever plate about the first and second axes brings the moveable contact into contact with the stationary contact in such a manner that a surface of the moveable contact moves across at least a portion of a surface of the stationary contact.

16. The method of claim 15, wherein movement of the surface of the moveable contact across at least a portion of the surface of the stationary contact creates a scrubbing motion that removes at least some contaminants on the surfaces of one or both of the contacts.

17. The method of claim 11, wherein a gap between the moveable and stationary contacts during an open state is at least 2 microns.

18. The method of claim 11, wherein applying an actuating force comprises raising the electric potential of the cantilever plate relative to the substrate.

19. The method of claim 18, wherein rotating the cantilever plate about a first axis occurs in response to a raising of the electric potential and rotating the cantilever plate about the second axis occurs in response to a raising of the electric potential.

20. A method for separating contacts on a MEMS device including a substrate with a stationary contact affixed thereto, an anchor affixed to the substrate, a torsion arm affixed to the anchor by a first torsion hinge with a first axis, and a cantilever plate with a moveable contact affixed thereto in aligned confronting relation to the stationary contact, the moveable contact being in contact with the stationary contact, the cantilever plate connected to the torsion arm by a second torsion hinge with a second axis, the method comprising:

reducing application of an actuating force applied to the MEMS device;

responsive to the reduced actuating force, rotating the cantilever plate in a first direction about the second axis of the second torsion hinge away from the substrate to move the moveable contact into only partial contact with the stationary contact; and responsive to the reduced actuating force, rotating the cantilever plate in a second direction opposite the first direction about the first axis of the first torsion hinge away from the substrate, wherein the rotation of the cantilever plate about the first and second axes fully separates the moveable contact from the stationary contact into an open state.

21. The method of claim 20, wherein a gap between the moveable and stationary contacts after being separated is at least 2 microns.

22. The method of claim 20, wherein the state of partial contact further comprises a state in which the moveable contact is in contact with and positioned at an angle relative to the stationary contact.

23. The method of claim 20, wherein before reducing the application of the actuation force, the cantilever plate is a position in which the cantilever plate is parallel to the substrate.

24. The method of claim 20, wherein rotation of the cantilever plate about the first and second axes initially separates the moveable contact from the stationary contact in such a manner that only a portion of a surface of the moveable contact is in contact with the stationary contact.

25. The method of claim 24, wherein initial separation creates an unzipping motion that peels apart the moveable and stationary contacts.

26. The method of claim 20, wherein reducing application of an actuating force comprises removing the actuating force.

27. The method of claim 20, wherein reducing application of an actuating force comprises lowering an electric potential of the cantilever plate relative to the substrate.

28. The method of claim 27, wherein rotating the cantilever plate about a second axis occurs in response to a lowering of the electric potential and rotating the cantilever plate about the first axis occurs in response to a lowering of the electric potential.

29. A MEMS device with a cantilever design, the device comprising:

a first substrate with a stationary contact affixed thereto;

a second substrate with an anchor affixed thereto, wherein the second substrate is in aligned confronting relation with the first substrate, the first and second substrates being bonded together;

a seal ring surrounding the bonded first and second substrates to hermetically seal the bonded substrates together to form a cavity between the bonded substrates;

a signal path that enters and exits the cavity using feedthroughs selected from a group consisting of: vias, lateral feedthroughs, and combinations thereof, a torsion arm affixed to the anchor by a first torsion hinge with a first axis; and a cantilever plate with a moveable contact affixed thereto in aligned confronting relation to the stationary contact, the cantilever plate connected to the torsion arm by a second torsion hinge with a second axis, the moveable contact positioned at an end of the cantilever plate adjacent to the second torsion hinge, the cantilever plate being substantially formed from silicon, wherein the first torsion hinge is adapted to rotate the cantilever plate about the first axis toward or away from the substrate in response to an actuating force and the second torsion hinge is adapted to rotate the cantilever plate about the second axis toward or away from the substrate in response to the actuating force moving the moveable contact into contact with the stationary contact or separating the moveable contact from the stationary contact.

30. The device of claim 29, wherein the first torsion hinge is adapted to rotate the cantilever plate about the first axis toward the first substrate in response to an increase in electric potential of the cantilever plate relative to the first substrate and the second torsion hinge is adapted to rotate the cantilever plate about the second axis toward the first substrate in response to a increase in the electric potential moving the moveable contact into contact with the stationary contact.

31. The device of claim 29, wherein the second torsion hinge is adapted to rotate the cantilever plate about the second axis away from the first substrate in response to an decrease in electric potential of the cantilever plate relative to the first substrate and the first torsion hinge is adapted to rotate the cantilever plate about the first axis away from the first substrate in response to a decrease in the electric potential separating the moveable contact from the stationary contact.

32. The device of claim 29, further comprising a horn contact affixed to the cantilever plate at an edge adjacent to the moveable contact, wherein the horn contact provides stabilization of the device as the cantilever plate is moved toward or away from the first substrate.

33. A MEMS device with a cantilever design, the device comprising:

a substrate with a stationary contact affixed thereto;

an anchor affixed to the substrate;

a torsion arm affixed to the anchor by a first torsion hinge with a first axis; and a cantilever plate with a moveable contact affixed thereto in aligned confronting relation to the stationary contacts and a horn contact affixed to the cantilever plate at an edge adjacent to the moveable contact, the cantilever plate connected to the torsion arm by a second torsion hinge with a second axis, wherein the first torsion hinge is adapted to rotate the cantilever plate about the first axis toward or away from the substrate in response to an actuating force and the second torsion hinge is adapted to rotate the cantilever plate about the second axis toward or away from the substrate in response to the actuating force moving the moveable contact into contact with the stationary contact or separating the moveable contact from the stationary contact, wherein the horn contact is adapted to contact the substrate upon actuation before the moveable contact comes into contact with the stationary contact.

34. The device of claim 33, wherein the first torsion hinge is adapted to rotate the cantilever plate about the first axis toward the substrate in response to an increase in electric potential of the cantilever plate relative to the substrate and the second torsion hinge is adapted to rotate the cantilever plate about the second axis toward the substrate in response to a further increase in the electric potential moving the moveable contact into contact with the stationary contact.

35. The device of claim 33, wherein the second torsion hinge is adapted to rotate the cantilever plate about the second axis away from the substrate in response to an decrease in electric potential of the cantilever plate relative to the substrate and the first torsion hinge is adapted to rotate the cantilever plate about the first axis away from the substrate in response to a further decrease in the electric potential separating the moveable contact from the stationary contact.

36. The device of claim 33, further comprising a second substrate in aligned confronting relation with the substrate, wherein the anchor, torsion arm, first and second torsion hinges, and cantilever plate with moveable contact are formed on the second substrate instead of the substrate.

37. The device of claim 36, wherein the substrate and the second substrate are bonded together and the first and second torsion hinges are adapted move the cantilever plate on the second substrate toward or away from the stationary contact on the substrate.

38. The device of claim 36, wherein the substrate and the second substrate are bonded together and wherein the device further comprises a seal ring around the bonded substrates to hermetically seal the substrates together.

39. The device of claim 38, further comprising a signal path that enters and exits a cavity formed between the bonded substrates using feedthroughs selected from a group consisting of: vias, lateral feedthroughs, and combinations thereof.

40. The device of claim 33, wherein one or more of the anchor, torsion arm and cantilever plate are fabricated out of a material selected from a group consisting of: silicon, a top single crystalline silicon layer of a silicon on insulator substrate, polysilicon, doped silicon, silicon geranium, gold, nickel, dielectrics, ceramic, and combinations thereof.

41. The device of claim 33, wherein the actuating force is selected from a group consisting of: electrostatic, electromagnetic, thermal, electrothermal, shape memory alloy, piezo, and combinations thereof.

42. The device of claim 33, wherein at least one of the stationary and the moveable contact are fabricated out of a material selected from a group consisting of: gold, gold nickel alloy, platinum, ruthenium, iridium, rhodium, ruthenium oxide, tungsten, rhenium, carbon, and combinations thereof.

43. The device of claim 33, wherein the cantilever plate is adapted to rotate about an axis of the horn contact and the second axis simultaneously when the moveable contact is moved toward or away from the stationary contact.

44. A MEMS device with a cantilever design, the device comprising:

a substrate with a stationary contact affixed thereto;

an anchor affixed to the substrate;

a torsion arm affixed to the anchor by a first torsion hinge with a first axis; and a cantilever plate with a moveable contact affixed thereto in aligned confronting relation to the stationary contacts and a second moveable contact affixed to the cantilever plate adjacent to the moveable contact, the cantilever plate connected to the torsion arm by a second torsion hinge with a second axis, wherein the first torsion hinge is adapted to rotate the cantilever plate about the first axis toward or away from the substrate in response to an actuating force and the second torsion hinge is adapted to rotate the cantilever plate about the second axis toward or away from the substrate in response to the actuating force moving the moveable contact into contact with the stationary contact or separating the moveable contact from the stationary contact, wherein the second moveable contact is adapted to maintain a parallel gap between and to prevent direct contact between the cantilever plate and the substrate upon actuation.

45. The device of claim 44, wherein the first torsion hinge is adapted to rotate the cantilever plate about the first axis toward the substrate in response to an increase in electric potential of the cantilever plate relative to the substrate and the second torsion hinge is adapted to rotate the cantilever plate about the second axis toward the substrate in response to a further increase in the electric potential moving the moveable contact into contact with the stationary contact.

46. The device of claim 44, wherein the second torsion hinge is adapted to rotate the cantilever plate about the second axis away from the substrate in response to an decrease in electric potential of the cantilever plate relative to the substrate and the first torsion hinge is adapted to rotate the cantilever plate about the first axis away from the substrate in response to a further decrease in the electric potential separating the moveable contact from the stationary contact.

47. The device of claim 44, further comprising a second substrate in aligned confronting relation with the substrate, wherein the anchor, torsion arm, first and second torsion hinges, and cantilever plate with moveable contact are formed on the second substrate instead of the substrate.

48. The device of claim 47, wherein the substrate and the second substrate are bonded together and the first and second torsion hinges are adapted move the cantilever plate on the second substrate toward or away from the stationary contact on the substrate.

49. The device of claim 47, wherein the substrate and the second substrate are bonded together and wherein the device further comprises a seal ring around the bonded substrates to hermetically seal the substrates together.

50. The device of claim 49, further comprising a signal path that enters and exits a cavity formed between the bonded substrates using feedthroughs selected from a group consisting of: vias, lateral feedthroughs, and combinations thereof.

51. The device of claim 44, wherein one or more of the anchor, torsion arm and cantilever plate are fabricated out of a material selected from a group consisting of: silicon, a top single crystalline silicon layer of a silicon on insulator substrate, polysilicon, doped silicon, silicon geranium, gold, nickel, dielectrics, ceramic, and combinations thereof.

52. The device of claim 44, wherein the actuating force is selected from a group consisting of: electrostatic, electromagnetic, thermal, electrothermal, shape memory alloy, piezo, and combinations thereof.

53. The device of claim 44, wherein at least one of the stationary and the moveable contact are fabricated out of a material selected from a group consisting of: gold, gold nickel alloy, platinum, ruthenium, iridium, rhodium, ruthenium oxide, tungsten, rhenium, carbon, and combinations thereof.

54. A method for actuating a MEMS device including a substrate with a stationary contact affixed thereto, an anchor affixed to the substrate, a torsion arm affixed to the anchor by a first torsion hinge with a first axis, and a cantilever plate with a moveable contact affixed thereto in aligned confronting relation to the stationary contacts and a second moveable contact affixed to the cantilever plate adjacent to the moveable contact, the cantilever plate connected to the torsion arm by a second torsion hinge with a second axis, the method comprising:

applying an actuating force to the MEMS device;

responsive to the actuating force, rotating the cantilever plate about the first axis of the first torsion hinge toward the substrate; and responsive to the actuating force, rotating the cantilever plate about the second axis of the second torsion hinge toward the substrate, wherein the rotation of the cantilever plate about the first and second axes first moves the second moveable contact into contact with the substrate and then moves the moveable contact into contact with the stationary contact.

55. The method of claim 54, wherein the MEMS device is a micro-switch.

56. The method of claim 54, wherein the rotation about the first axis moves the moveable contact into a state of initial closure with the stationary contact.

57. The method of claim 54, wherein the rotation about the second axis moves the moveable contact into a state of full contact with the stationary contact.

58. The method of claim 54, wherein rotation of the cantilever plate about the first and second axes brings the moveable contact into contact with the stationary contact in such a manner that a surface of the moveable contact moves across at least a portion of a surface of the stationary contact.

59. The method of claim 58, wherein movement of the surface of the moveable contact across at least a portion of the surface of the stationary contact creates a scrubbing motion that removes at least some contaminants on the surfaces of one or both of the contacts.

60. The method of claim 54, wherein a gap between the moveable and stationary contacts during an open state is at least 2 microns.

61. The method of claim 54, wherein applying an actuating force comprises raising the electric potential of the cantilever plate relative to the substrate.

62. The method of claim 61, wherein rotating the cantilever plate about a first axis occurs in response to a raising of the electric potential and rotating the cantilever plate about the second axis occurs in response to a raising of the electric potential.

63. A method for separating contacts on a MEMS device including a substrate with a stationary contact affixed thereto, an anchor affixed to the substrate, a torsion arm affixed to the anchor by a first torsion hinge with a first axis, and a cantilever plate with a moveable contact affixed thereto in aligned confronting relation to the stationary contact and a second moveable contact affixed to the cantilever plate adjacent to the moveable contact, the moveable contact being in contact with the stationary contact, the cantilever plate connected to the torsion arm by a second torsion hinge with a second axis, the method comprising:

reducing application of an actuating force applied to the MEMS device;

responsive to the reduced actuating force, rotating the cantilever plate about the second axis of the second torsion hinge away from the substrate; and responsive to the reduced actuating force, rotating the cantilever plate about the first axis of the first torsion hinge away from the substrate, wherein the rotation of the cantilever plate about the first and second axes first moves the second moveable contact to no longer be in contact with the substrate and then separates the moveable contact from the stationary contact.

64. The method of claim 63, wherein a gap between the moveable and stationary contacts after being separated is at least 2 microns.

65. The method of claim 63, wherein the rotation about the second axis moves the moveable contact into a state of initial separation from the stationary contact.

66. The method of claim 63, wherein the rotation about the second axis moves the device into an open state of full separation of the moveable contact from the stationary contact.

67. The method of claim 63, wherein rotation of the cantilever plate about the first and second axes initially separates the moveable contact from the stationary contact in such a manner that only a portion of a surface of the moveable contact is in contact with the stationary contact.

68. The method of claim 67, wherein initial separation creates an unzipping motion that peels apart the moveable and stationary contacts.

69. The method of claim 63, wherein reducing application of an actuating force comprises removing the actuating force.

70. The method of claim 63, wherein reducing application of an actuating force comprises lowering an electric potential of the cantilever plate relative to the substrate.

71. The method of claim 70, wherein rotating the cantilever plate about a second axis occurs in response to a lowering of the electric potential and rotating the cantilever plate about the first axis occurs in response to a lowering of the electric potential.

72. A MEMS device with a cantilever design, the device comprising:

a first substrate with a stationary contact affixed thereto;

a second substrate with an anchor affixed thereto, wherein the second substrate is in aligned confronting relation with the first substrate, the first and second substrates being bonded together;

a seal ring surrounding the bonded first and second substrates to hermetically seal the bonded substrates together to form a cavity between the bonded substrates;

a signal path that enters and exits the cavity using feedthroughs selected from a group consisting of: vias, lateral feedthroughs, and combinations thereof;

a torsion arm affixed to the anchor by a first torsion hinge with a first axis; and a cantilever plate with a moveable contact affixed thereto in aligned confronting relation to the stationary contacts and a horn contact affixed to the cantilever plate at an edge adjacent to the moveable contact, the cantilever plate connected to the torsion arm by a second torsion hinge with a second axis, the cantilever plate being substantially formed from silicon, wherein the first torsion hinge is adapted to rotate the cantilever plate about the first axis toward or away from the substrate in response to an actuating force and the second torsion hinge is adapted to rotate the cantilever plate about the second axis toward or away from the substrate in response to the actuating force moving the moveable contact into contact with the stationary contact or separating the moveable contact from the stationary contact, wherein the horn contact is adapted to contact the first substrate upon actuation before the moveable contact comes into contact with the stationary contact.

73. The device of claim 72, wherein the first torsion hinge is adapted to rotate the cantilever plate about the first axis toward the first substrate in response to an increase in electric potential of the cantilever plate relative to the first substrate and the second torsion hinge is adapted to rotate the cantilever plate about the second axis toward the first substrate in response to a increase in the electric potential moving the moveable contact into contact with the stationary contact.

74. The device of claim 72, wherein the second torsion hinge is adapted to rotate the cantilever plate about the second axis away from the first substrate in response to an decrease in electric potential of the cantilever plate relative to the first substrate and the first torsion hinge is adapted to rotate the cantilever plate about the first axis away from the first substrate in response to a decrease in the electric potential separating the moveable contact from the stationary contact.

75. The device of claim 72, wherein the horn contact provides stabilization of the device as the cantilever plate is moved toward or away from the first substrate.

76. A MEMS device with a cantilever design, the device comprising:

a substrate with a stationary contact affixed thereto;

an anchor affixed to the substrate;

a torsion arm moveably affixed to the anchor by a first hinge; and a cantilever plate with a moveable contact affixed thereto in aligned confronting relation to the stationary contact, the cantilever plate moveably connected to the torsion arm by a second hinge wherein the first hinge is configured for a first stage of rotation about a first axis toward or away from the substrate and the second hinge is configured to be stiffer than the first hinge for a second stage of rotation about a second axis toward or away from the substrate, the rotation about the axes occurring in response to the actuating force for moving the moveable contact.

* * * * *

UNITED STATES PATENT AND TRADEMARK OFFICE

CERTIFICATE OF CORRECTION

PATENT NO. : 7,692,521 B1
APPLICATION NO. : 11/433044
DATED : April 6, 2010
INVENTOR(S) : Michael B. Cohn It is certified that error appears in the above-identified patent and that said Letters Patent is hereby corrected as shown below:

In claim 44, Column 17, Line 28, delete "s" in "contacts" so it reads --contact--, claim 54, Column 18, Line 33, delete "s" in "contacts" so it reads --contact--, and claim 72, Column 20, Line 14, delete "s" in "contacts" so it reads --contact--.

Signed and Sealed this

Twenty-ninth Day of June, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,692,521 B1
APPLICATION NO. : 11/433044
DATED : April 6, 2010
INVENTOR(S) : Michael B. Cohn It is certified that error appears in the above-identified patent and that said Letters Patent is hereby corrected as shown below:

In claim 33, Column 16, Line 18, delete "s" in "contacts" so it reads --contact--.

Signed and Sealed this

Tenth Day of August, 2010

David J. Kappos

David J. Kappos
*Director of the United States Patent and Trademark Office*